US008068078B2

(12) United States Patent
Lee et al.

(10) Patent No.: US 8,068,078 B2
(45) Date of Patent: Nov. 29, 2011

(54) ELECTRO-LUMINESCENCE DISPLAY DEVICE AND DRIVING APPARATUS THEREOF

(75) Inventors: Han Sang Lee, Uiwang-shi (KR); Sung Ki Kim, Seoul (KR); Hae Yeol Kim, Uiwang-shi (KR); Juhn Suk Yoo, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1250 days.

(21) Appl. No.: 10/825,426

(22) Filed: Apr. 16, 2004

(65) Prior Publication Data

US 2005/0140599 A1 Jun. 30, 2005

(30) Foreign Application Priority Data

Dec. 30, 2003 (KR) ..... 10-2003-0099752

(51) Int. Cl.
*G09G 3/36* (2006.01)

(52) U.S. Cl. ..... 345/95; 345/55

(58) Field of Classification Search ..... 345/76–82, 345/92, 95, 98, 99, 36, 42, 48, 55, 84; 315/169.1, 315/169.3
See application file for complete search history.

(56) References Cited

U.S. PATENT DOCUMENTS 2,890,332 A * 6/1959 Kochevar ..... 327/506
6,486,470 B2 * 11/2002 Huang ..... 250/307
6,731,273 B2 * 5/2004 Koyama et al. ..... 345/204
6,858,991 B2 * 2/2005 Miyazawa ..... 315/169.3
7,119,763 B2 * 10/2006 Okuda ..... 345/36
2002/0051893 A1 * 5/2002 Gao et al. ..... 428/690
2002/0158587 A1 * 10/2002 Komiya ..... 315/169.3
2003/0011584 A1 * 1/2003 Azami et al. ..... 345/204
2006/0139251 A1 * 6/2006 Morosawa et al. ..... 345/76

FOREIGN PATENT DOCUMENTS

WO WO03065334 * 8/2003

* cited by examiner

*Primary Examiner* — Quan-Zhen Wang
*Assistant Examiner* — Calvin C Ma
(74) *Attorney, Agent, or Firm* — McKenna Long & Aldridge, LLP.

(57) ABSTRACT

The present invention relates to an electro-luminescence display and a driving method thereof wherein a thin film transistor is prevented from the deterioration, to thereby improve a picture quality. An electro-luminescence (EL) display, including: a plurality of drive voltage supply lines; N compensation voltage supply lines; EL cells at each crossing of a plurality of data lines and a plurality of gate lines in a matrix, wherein the EL cells emit light in response to currents applied from the drive voltage supply lines; driving thin film transistors (TFT) connected between the EL cells and compensation voltage supply lines that control the current applied to the EL cells; and a bias switch, connected between the N−1th compensation voltage supply line and a control terminal of the driving TFT connected to the Nth compensation voltage supply line that applies a bias voltage to the driving TFT when a scan pulse is supplied to the N−1th gate line.

6 Claims, 14 Drawing Sheets

ELECTRO-LUMINESCENCE DISPLAY DEVICE AND DRIVING APPARATUS THEREOF

This application claims the benefit of Korean Patent Application No. P2003-99752, filed on Dec. 30, 2003, which is hereby incorporated by reference for all purposes as if fully set forth herein.

BACKGROUND OF THE INVENTION

1. Field of the Invention

This invention relates to an electro-luminescence display (ELD), and more particularly to an electro-luminescence display device and a driving apparatus thereof that prevents the deterioration of a thin film transistor to enhance image quality of the ELD.

2. Description of the Related Art

Recently, various flat panel display devices have been developed that eliminate disadvantages of a cathode ray tube (CRT) by reducing the weight and bulk of the display. Such flat panel display devices include a liquid crystal display (LCD), a field emission display (FED), a plasma display panel (PDP) and an electro-luminescence (EL) display, etc.

The EL display is a self-luminous device capable of emitting light by a re-combination of electrons with holes using a phosphorous material.

The EL display device is generally classified as an inorganic EL device using the phosphorous material in an inorganic compound or an organic EL device using the phosphorous material in an organic compound. EL display devices have many advantages such as a low voltage driving, self-luminescence, a thin profile, a wide viewing angle, a fast response speed, a high contrast, etc.

The organic EL device includes an electron injection layer, an electron carrier layer, a light-emitting layer, a hole carrier layer and a hole injection layer. In the organic EL device, when a predetermined voltage is applied between an anode and a cathode, electrons produced from the cathode are moved, via the electron injection layer and the electron carrier layer, into the light-emitting layer while holes produced from the anode are moved, via the hole injection layer and the hole carrier layer, into the light-emitting layer. Thus, the electrons and the holes fed from the electron carrier layer and the hole carrier layer into the light-emitting layer emit light by the recombination of the electrons and the holes.

Referring to FIG. 1, an active matrix type EL display device using the above-mentioned organic EL device includes an EL panel 20 having pixels 28 arranged at each crossing between gate lines GL and data lines DL, a gate driver 22 driving the gate lines GL of the EL panel 20, a data driver 24 driving the data lines DL of the EL panel 20, and a gamma voltage generator 26 supplying the data driver 24 with a plurality of gamma voltages.

The gate driver 22 applies a scanning pulse to the gate lines GL to sequentially drive the gate lines SL. The data driver 24 converts a digital data signal received from an external signal source into an analog data signal using a gamma voltage from the gamma voltage generator 26. The data driver 24 applies the analog data signal to the data lines DL whenever the scanning pulse is supplied.

Each of the pixels 28 receives a data signal from the data line DL and generates light corresponding to the data signal when a scan pulse is applied to a gate line GL.

As shown in FIG. 2, each pixel 28 includes an EL cell OEL having an anode connected to the voltage source VDD and a cathode connected to a cell driver 30, a gate line GL, a data line DL and a ground voltage source GND to drive the EL cell OEL.

The cell driver 30 includes a switching thin film transistor T1 having a gate terminal connected to the gate line GL, a source terminal connected to the data line DL and a drain terminal connected to a first node N1, a driving thin film transistor T2 having a gate terminal connected to the first node N1, a drain terminal connected to the ground voltage source GND and a source terminal connected to the EL cell OEL, and a storage capacitor Cst connected between the ground voltage source GND and the first node N1.

The switching thin film transistor T1 is turned on when the scan pulse is applied to the gate scan line GL, to thereby apply the data signal, which is supplied from the data line DL, to the first node N1. The data signal supplied to the first node N1 is charged into the storage capacitor Cst and is applied to the gate terminal of the driving thin film transistor T2. The driving thin film transistor T2 controls a current I fed from the voltage source VDD via the EL cell OEL in response to the data signal applied to the gate terminal thereof, to thereby control the amount of light emitted from the EL cell OEL. Furthermore, even though the switching thin film transistor T1 is turned off, the driving thin film transistor T2 maintains an on state because of the data signal charged in the storage capacitor Cst and thus continues to control the current I from the voltage source VDD via the EL cell OEL until a data signal is supplied at the next frame.

The current I flowing to the EL cell OEL may be represented as a formula 1.

$$I = \frac{W}{2L} Cox(Vg2 - Vth)^2 \qquad \text{[Formula 1]}$$

Herein, W represents the width of a driving thin film transistor T2 and L represents the length of the driving thin film transistor T2. Cox represents the capacitor value provided by a dielectric layer which forms one layer. Further, Vg2 represents the voltage value of the data signal applied to the gate terminal of the driving thin film transistor T2 and Vth represents a threshold voltage value of the driving thin film transistor T2.

In the formula 1, parameters W, L, Cox and Vg2 do not vary as the thin film transistor T2 ages.

However, the driving thin film transistor deteriorates due to a continuous supply of a positive voltage to the gate terminal, and its current driving scheme. A threshold voltage of the driving thin film transistor increases over time because the driving thin film transistor deteriorates. As described above, if the threshold voltage of the driving thin film transistor is increased, the amount of current flowing to the EL cell OEL can not be accurately controlled, so that the luminance is decreased and the desired image is not displayed.

The driving thin film transistor T2 is made using hydrogenated amorphous silicon. Hydrogenated amorphous silicon has an advantage in that it is easy to manufacture in a large scale and it is possible to the deposit at low temperatures less than 350° C. Thus, the thin film transistors are typically made using the hydrogenated amorphous silicon.

However, in hydrogenated amorphous silicon there exists a Weak Si—Si bond 32 and a dangling bond as shown in FIG. 3 because of a disordered atom array. Over time, an Si bonded by the Weak Si—Si bond migrates from the atom array as shown in FIG. 3B, and thus the electrons and the holes recombine in the site from which the Si has migrated, or a migration state remains. The change in the atomic structure of the hydrogenated amorphous silicon induces a change of energy level such that the threshold voltage Vth of the driving thin film transistor is increased to the values of Vth', Vth", Vth'" as shown in FIG. 4. Consequently, due to the increased threshold voltage of the driving thin film transistor, it is difficult to accurately represent the brightness of the image as desired in the EL panel 20. Furthermore, a small decrease of the brightness results in an residual image in the EL panel 20, thereby adversely effecting image quality.

SUMMARY OF THE INVENTION

Accordingly, the present invention is directed to an electro-luminescence display device and driving apparatus thereof that substantially obviates one or more of the problems due to limitations and disadvantages of the related art.

An advantage of the present invention is to provide an electro-luminescence display device and a driving apparatus thereof capable of preventing the deterioration of a thin film transistor, to thereby improve a quality of picture.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an electro-luminescence (EL) display, including: a plurality of drive voltage supply lines; a plurality of compensation voltage supply lines; EL cells at each crossing of a plurality of data lines and a plurality of gate lines in a matrix, wherein the EL cells emit light in response to currents applied from the drive voltage supply lines; driving thin film transistors (TFT) connected between the EL cells and compensation voltage supply lines that control the current applied to the EL cells; and a bias switch, connected between the N−1th compensation voltage supply line and a control terminal of the driving TFT connected to the Nth compensation voltage supply line that applies a bias voltage to the driving TFT when a scan pulse is supplied to the N−1th gate line.

In another aspect of the present invention, a method of driving an electro-luminescence (EL) display having an EL cell formed at every crossing of a plurality of data lines and gate lines in a matrix that emitting light in response to current applied from driving voltage supply lines, and a driving thin film transistor connected between the EL cell and a compensation voltage supply line that controls the amount of the current applied to the EL cell, includes: supplying a scan pulse to the N−1th gate line to drive the driving TFT and thereby the light-emitting the EL cell; and allowing a bias voltage to flow through the driving TFT using a bias switch connected between a control terminal of the driving TFT connected to the Nth compensation voltage supply line and the N−1th compensation voltage supply line depending upon the scan pulse supplied to the N−1th gate line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to an embodiment of the present invention, example of which is illustrated in the accompanying drawings.

Hereinafter, embodiments of the present invention will be described in detail with reference to FIGS. 5 to 13.

Figure 1:
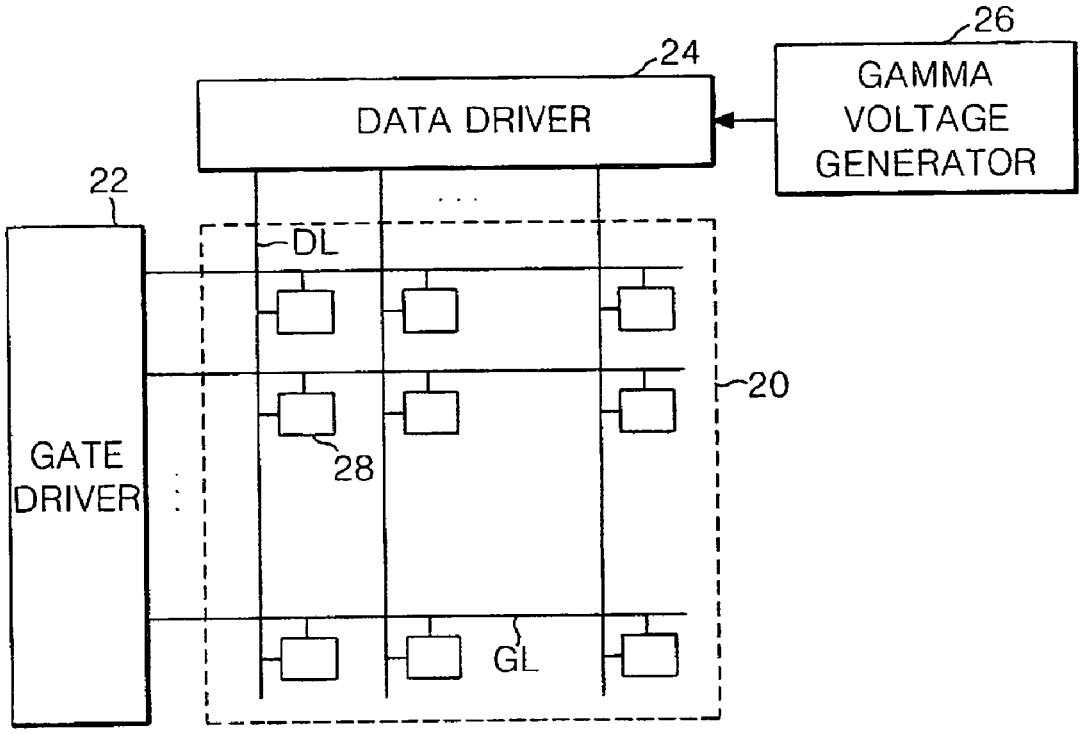
FIG. 1 RELATED ART
FIG. 1 is a schematic block diagram of a related art EL display according to the related art.
Figure 2:
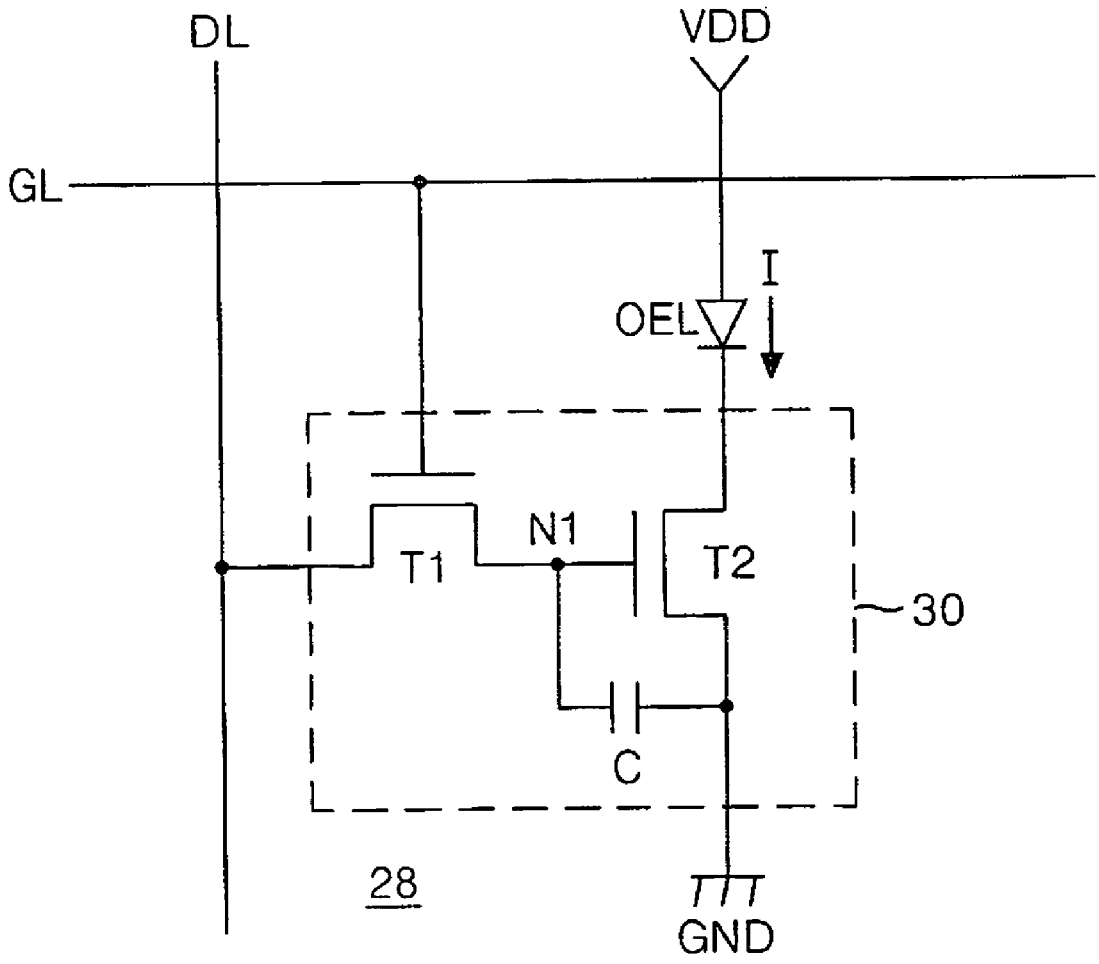
FIG2 RELATED ART
FIG. 2 is a detailed circuit diagram of a pixel shown in FIG. 1 according to the related art.
Figure 3A:
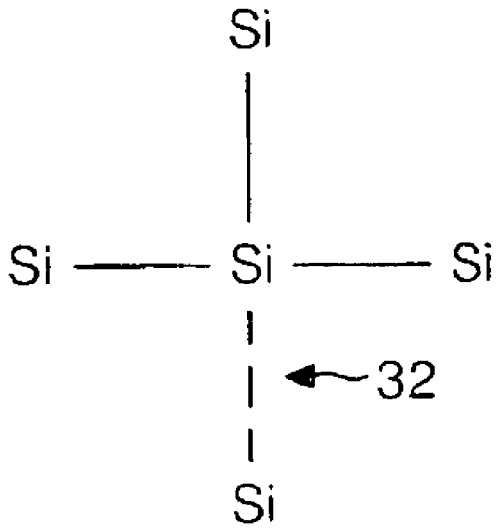
FIG.3A RELATED ART
FIG. 3A and FIG. 3B show a configuration representing atom array of an amorphous silicon.
Figure 3B:
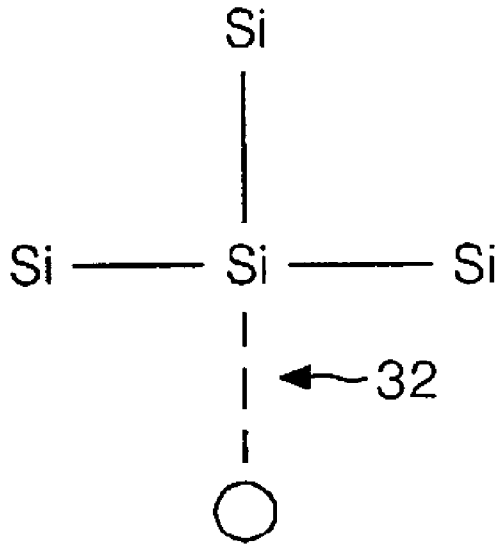
FIG.3B RELATED ART
Figure 4:
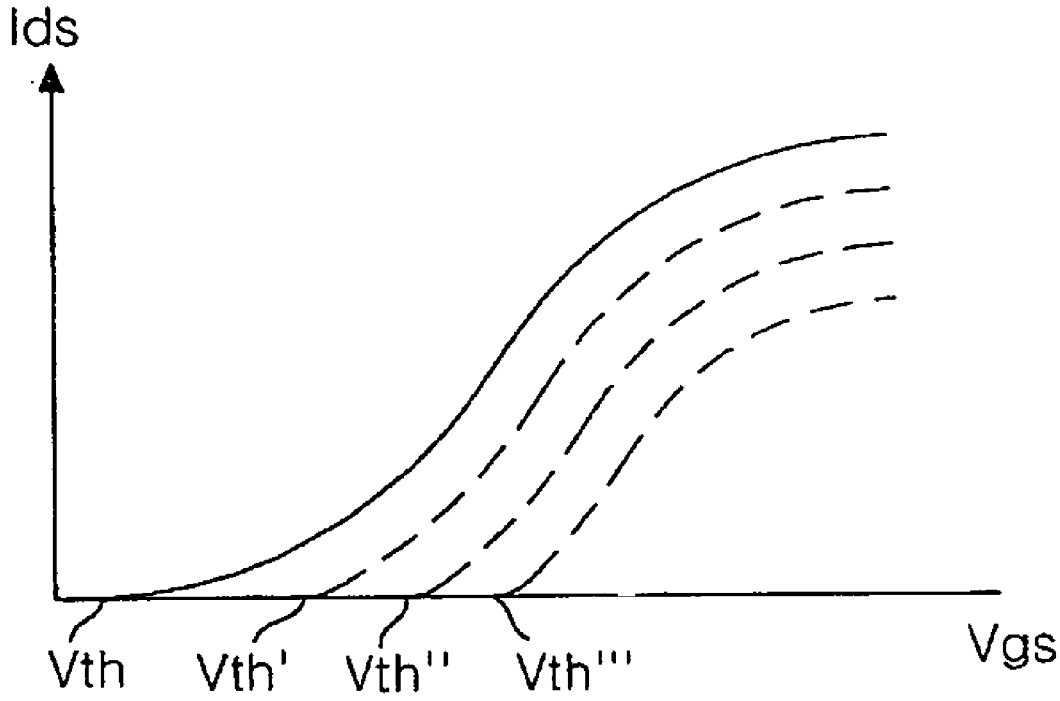
FIG. 4 RELATED ART
FIG. 4 is a graph showing the change in a threshold voltage according to a deterioration of a driving thin film transistor.
Figure 5:
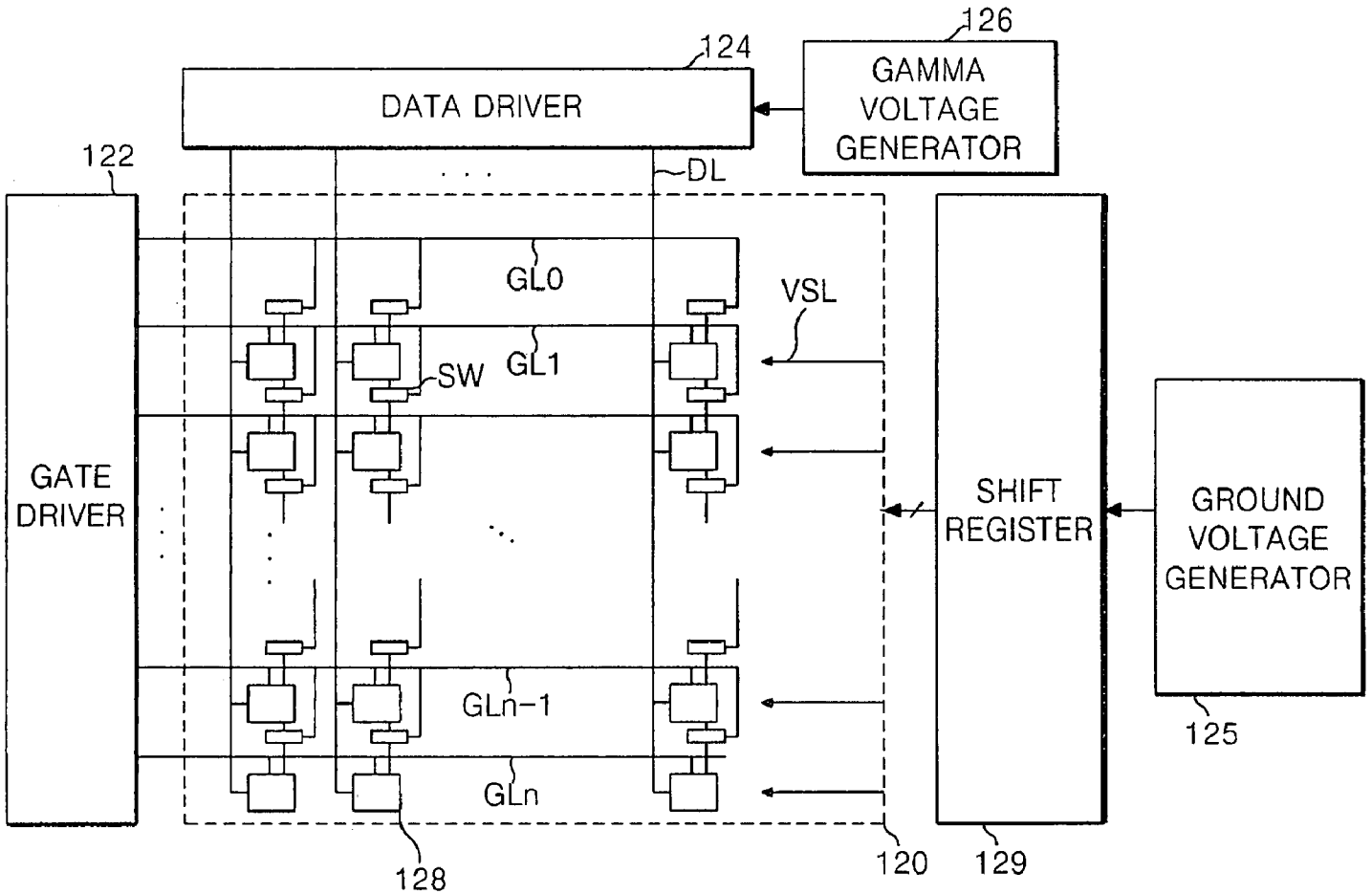
FIG. 5 is a schematic block diagram of an electro-luminescence display according to a first embodiment of the present invention.

FIG. 5 illustrates an electro-luminescence display (EL) according to a first embodiment of the present invention. The EL display includes a EL panel 120 having a pixel arranged at each crossing between gate lines GL and data lines DL, a gate driver 122 driving the gate lines GL of the EL panel 120, a data driver 124 driving the data lines DL of the EL panel 120, a gamma voltage generator 126 supplying a plurality of gamma voltages to the data driver 124, a compensation voltage generator 125 generating a compensation voltage VSS, a shift register block 129 having a plurality of shift registers and sequentially supplying the compensation voltage from the compensation voltage generator 125 to a plurality of the compensation voltage supply lines VSL formed on the EL panel 120 and a plurality of bias switches SW connected between adjacent pixels in a vertical direction to supply the compensation voltage VSS from the compensation voltage supply line VSL to the pixels 128 of next stage.

The gate driver 122 supplies a scan pulse to the gate line GL to drive the gate lines GL sequentially.

The data driver 124 converts a digital signal from an external signal source into an analog signal using the gamma voltages from the gamma voltage generator 126. Also, the data driver 124 supplies the analog signal to the data lines DL whenever the scan pulse is supplied.

The ground generator 125 generates a compensation voltage VSSH with a high state and supplies it to the shift register 129. The ground generator 125 generates a current of several mA wherein the voltage drop is less than tens of mV.

The shift register block 129 sequentially shifts the compensation voltage VSSH from the compensation voltage generator 125 using the plurality of shift registers and supplies it to the plurality of the compensation voltage supply lines VSL. Accordingly, each of the compensation voltage supply lines VSL in the EL panel 120 is independently driven by each line. The shift register block 129 may be internal or external to the EL panel 120.

Each of the pixels 128 along a gate line is supplied with the data signal from the data line DL when the scan pulse is supplied to the gate line GL and generates light corresponding to the data signal.

Figure 6:
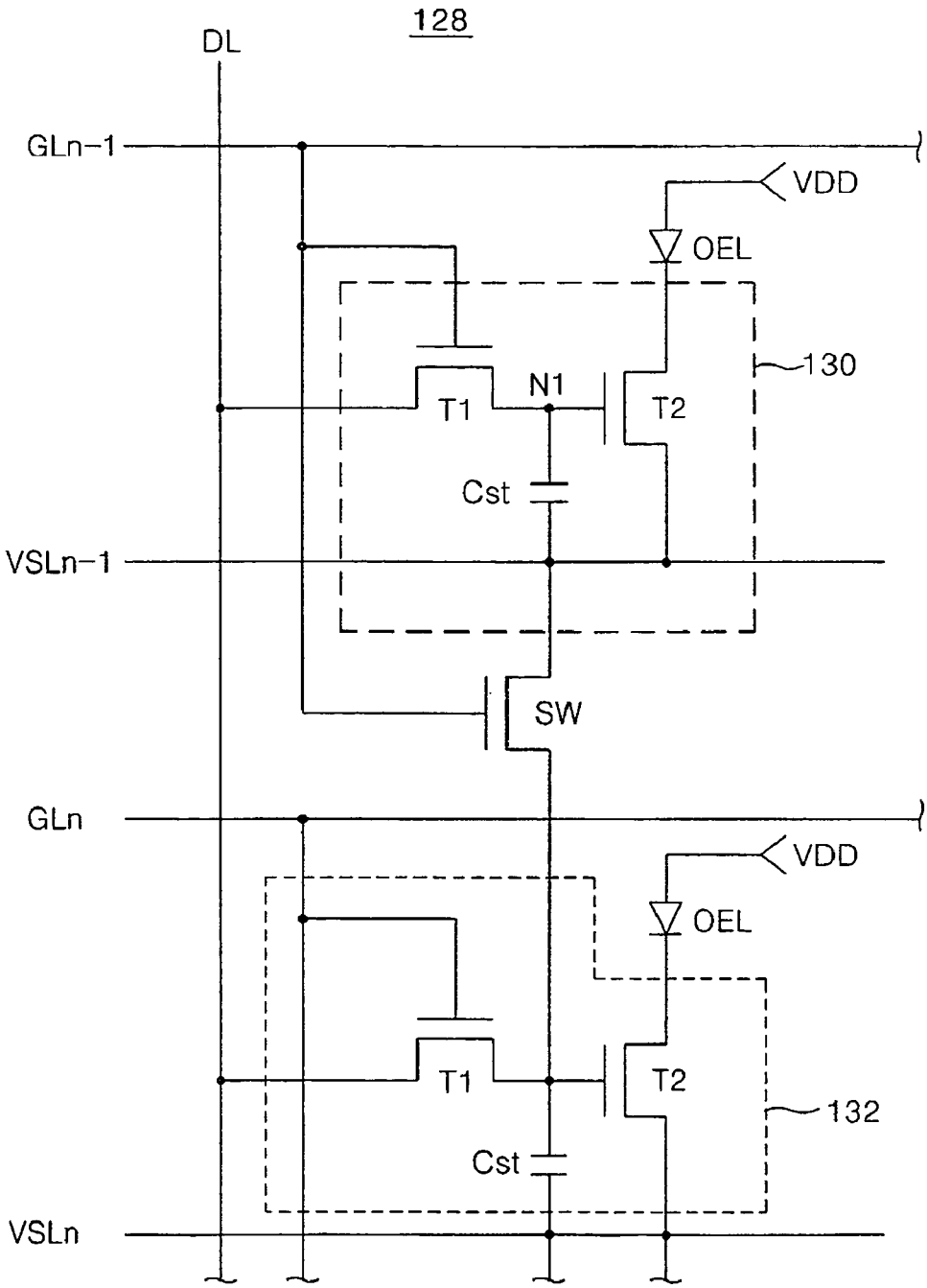
FIG. 6 is a circuit diagram of the pixel shown in FIG. 5.

FIG. 6 shows a circuit diagram of the pixel shown in FIG. 5. The pixel 128 includes an EL cell OEL having an anode connected to the voltage source VDD, and a cell driver 130 connected to a cathode of the EL cell, a gate line GLn-1, the data line DL and the compensation voltage supply line VSL to drive the EL cell OEL.

The cell driver 130 includes a switching thin film transistor T1 having a gate terminal connected to the gate line GLn-1, a source terminal connected to the data line DL and a drain terminal connected to a first node N1; a driving thin film transistor T2 having the gate terminal connected to the first node N1, the source terminal connected to the compensation voltage supply line VSLn-1 and the drain terminal connected to the EL cell OEL; and a storage capacitor Cst connected between a compensation voltage supply line VSLn-1 and the first node N1.

The switching thin film transistor T1 is turned on when the scan pulse is applied to the gate line GL to apply a data signal supplied to the data line DL to the first node N1. The data signal supplied to the first node N1 is charged onto the storage capacitor Cst and applied to the gate terminal of the driving thin film transistor T2. The driving thin film transistor T2 controls a current I fed from the voltage source VDD via EL cell OEL in response to the data signal applied to the gate terminal to control the amount of a light-emission from the EL cell OEL. Further, even though the switching thin film transistor T1 is turned off, the driving thin film transistor T2 maintains an on state due to the charge on the storage capacitor Cst corresponding to the data signal and can control the current I fed from the voltage source VDD via the EL cell OEL until a data signal at the next frame is supplied.

A bias switch SW, as shown in FIG. 6, has a gate terminal connected to a gate line GLn-1, a source terminal connected to a compensation voltage supply line VSLn-1 and a drain terminal connected to a first node N1 of a cell driver 132 of pixel 128 in the next stage.

The bias switch SW supplies a compensation voltage VSSL with a low state from the N−1th compensation voltage supply line VSLn-1 to the first node N1 of a Nth pixel cell when the scan pulse is supplied to the gate line GLn-1. Accordingly, the compensation voltage VSSL supplied on the first node N1 of the Nth pixel cell 128 is supplied to the gate terminal of the driving thin film transistor T2. A compensation voltage with a high state VSSH supplied to a Nth compensation voltage supply line VSLn from a shift register 129 is applied to a source terminal of the driving thin film transistor T2. Therefore, a voltage Vgs between the gate terminal G and the source terminal S of the driving thin film transistor T2 to drive the EL cell OEL of the Nth pixel 128 is the difference of the compensation voltage VSSL supplied to the gate terminal G via the bias switch SW from the compensation voltage supply line VSLn-1 and the compensation voltage VSSH supplied to the compensation voltage supply line VSLn. Thus, the bias switch SW supplies a negative bias voltage −Vgs to the driving thin film transistor T2 using the compensation voltage VSSL, thereby compensating for a change in the threshold voltage Vth.

Figure 7:
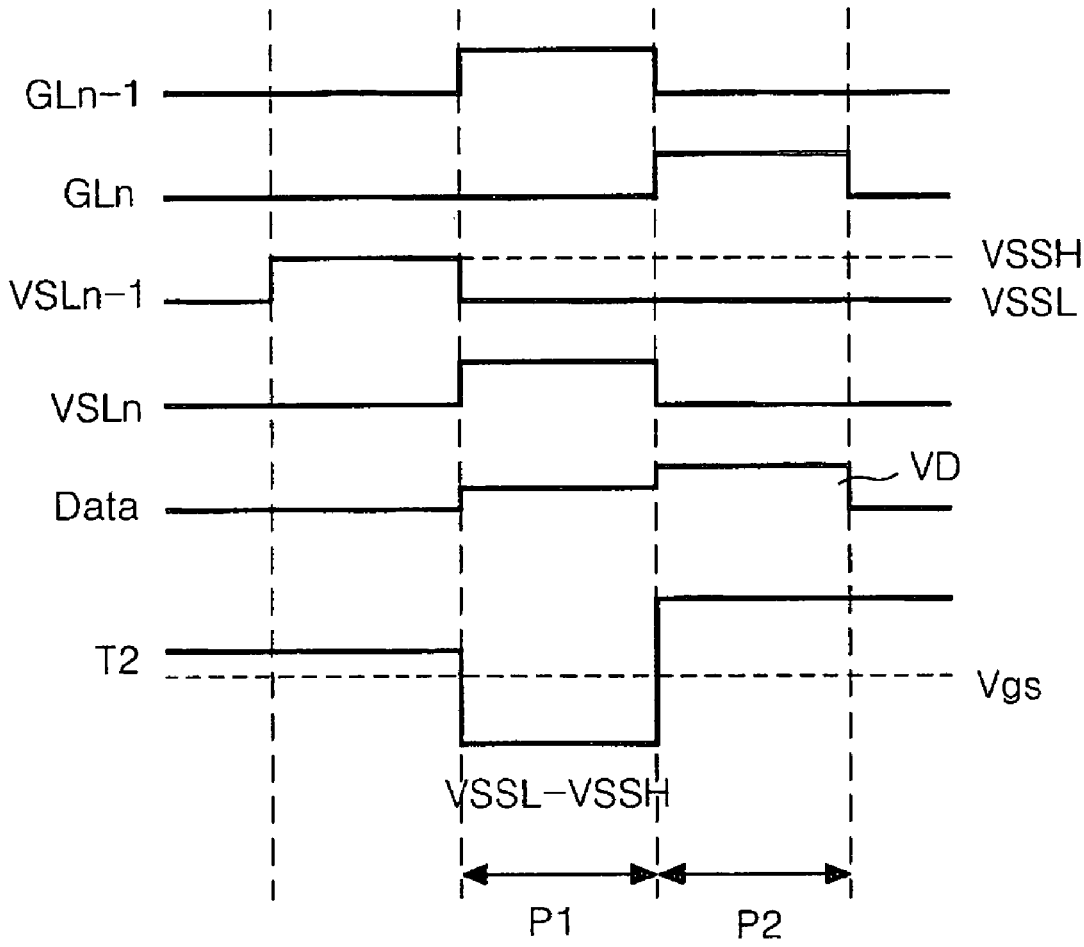
FIG. 7 is a variety of driving waveforms used for driving a pixel shown in FIG. 6.

FIG. 7 illustrates the driving waveforms used to drive the cell driver 130. FIG. 7 in conjunction with FIG. 6 will be used to explain the driving method of the EL display according to a first embodiment of the present invention.

The EL display and driving method of the first embodiment displays an image on the N−1th pixel cell 128 using the scan pulse supplied to a gate line GLn-1 and, at the same time, supplies the negative bias voltage −Vgs to the driving thin film transistor T2 of the Nth pixel cell 128 using the scan pulse on the gate line GLn-1 to compensate for the change in the threshold voltage Vth of the driving thin film transistor T2 driving the Nth pixel cell. Herein, the N−1th pixel cell is connected to the gate line GLn-1 and the Nth pixel cell is connected to the gate line GLn.

In the interval P1 shown in FIG. 7, the scan pulse is supplied to the gate line GLn-1. Further, the compensation voltage VSSL is supplied to the compensation voltage supply line VSLn-1 connected to the source terminal of the driving thin film transistor T2 of the N−1th pixel cell, and the compensation voltage VSSH of high state is supplied to the compensation voltage supply line VSLn connected to the source terminal of the driving thin film transistor T2 of the Nth pixel cell from the shift register 129.

Figure 8:
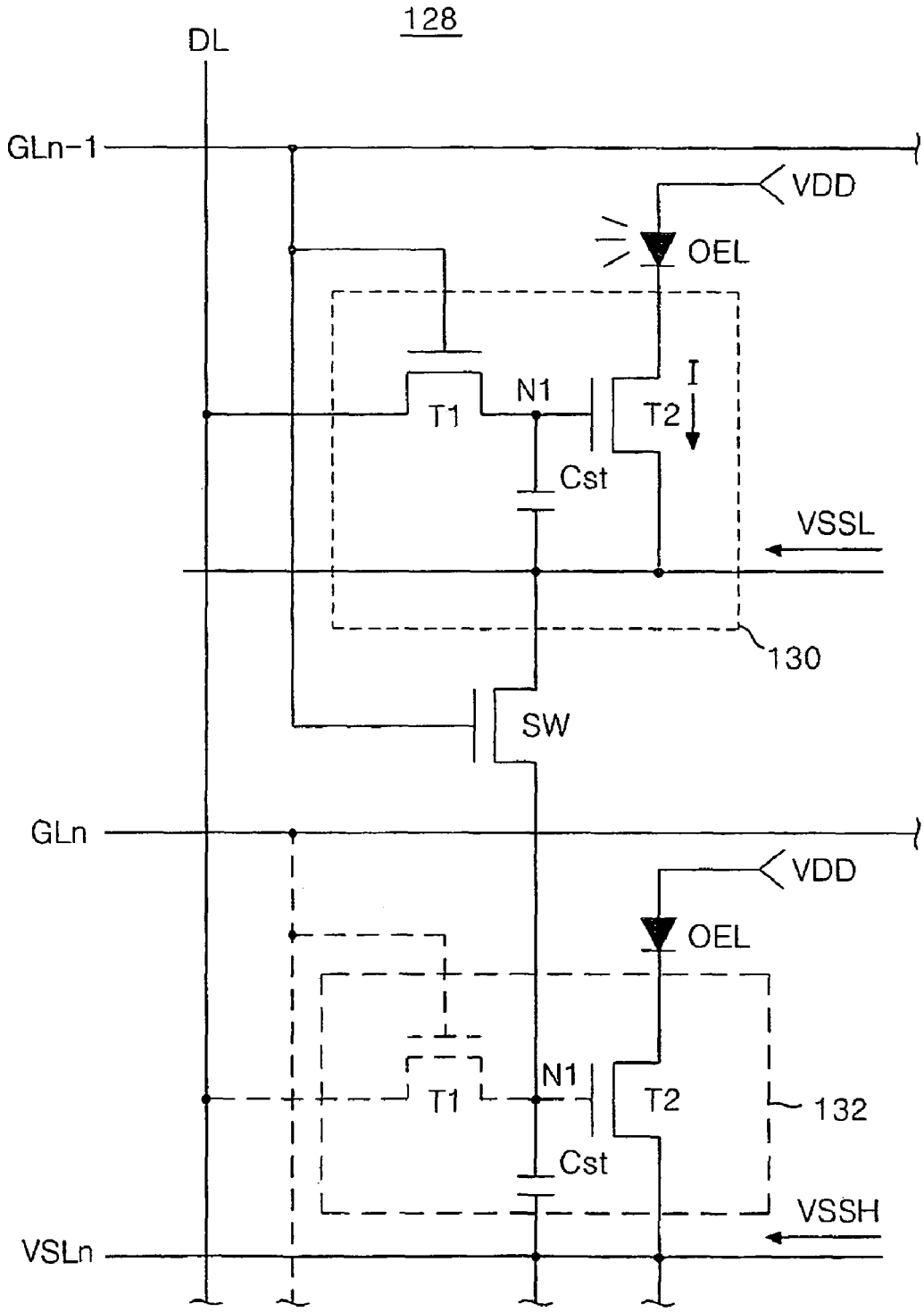
FIG. 8 is a circuit diagram of pixels adjacent in a vertical direction operating in the interval P1 shown in FIG. 7.

As shown in FIG. 8, the switching thin film transistor T1 of the N−1th pixel cell and the bias switch are turned on. The data signal VD supplied to the data line DL, is applied to the first node N1 via the switching thin film transistor T1 of the N−1th pixel cell. The data signal VD is charged onto the storage capacitor Cst and applied to the gate terminal of the driving thin film transistor T2, and the compensation voltage VSSL supplied to the compensation voltage supply line VSLn-1 is supplied to the source terminal of the driving thin film transistor T2. The driving thin film transistor T2 of the N−1th pixel controls a current I flowing from the voltage source VDD through the EL cell OEL in response to the data signal applied to the gate terminal to control the amount of light emitting from the EL cell OEL. At the same time, the compensation voltage VSSL with a low state supplied to the compensation voltage supply line VSLn-1, via the bias switch SW, is supplied to the first node N1 of the Nth pixel cell. Then, the compensation voltage VSSL is supplied to the gate line of the driving thin film transistor T2 of the Nth pixel cell. Accordingly, the negative bias voltage −Vgs is supplied to the driving thin film transistor T2 due to the difference between the compensation voltage VSSL supplied to the gate line from the compensation voltage supplying VSLn-1 via the bias switch SW and the compensation voltage VSSH supplied to the source terminal from the compensation voltage supply line VSLn. Thus, the threshold voltage of the driving thin film transistor T2 of the Nth pixel cell is compensated by the negative bias voltage −Vgs.

Figure 9:
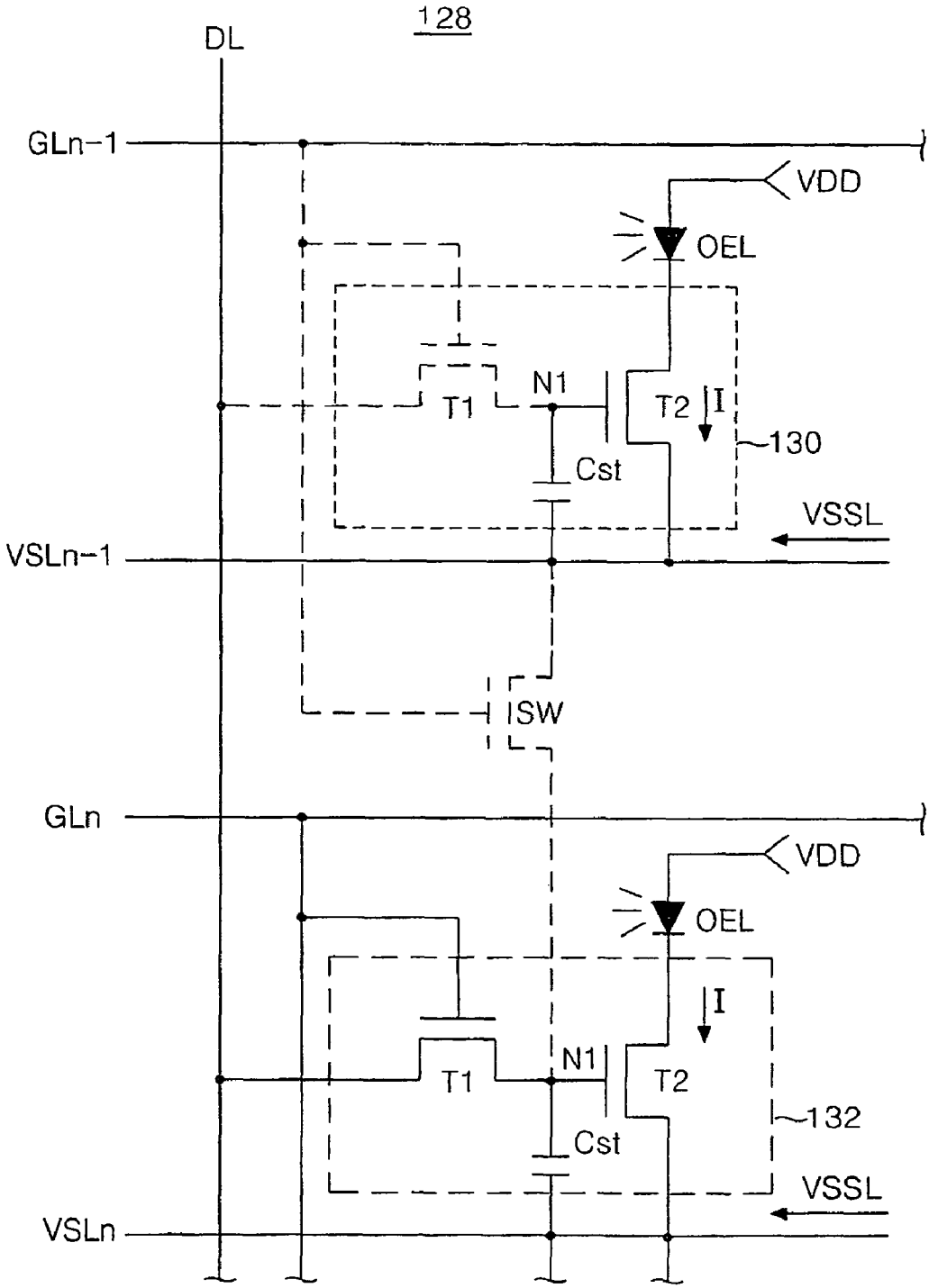
FIG. 9 is a circuit diagram of pixels adjacent in a vertical direction operating in the interval P2 shown in FIG. 7.

On the other hand, during the interval P2 shown in FIG. 8, the scan pulse supplied to the gate line GLn-1 is turned off and then the scan pulse is supplied to the Nth gate line GLn. Even though the switching thin film transistor T1 of the N−1th pixel cell is in an off state, the driving thin film transistor T2 of the N−1th pixel cell maintains an on state because of the data signal charged on the storage capacitor Cst and can control a current I flowing from the voltage source VDD through the EL cell OEL until a data signal for the next frame is supplied. At the same time as shown in FIG. 9, the driving thin film transistor T2 of the Nth pixel cell is turned on by the scan pulse supplied to the gate line GLn to control a current I supplied to the Nth pixel. The threshold voltage Vth of the driving thin film transistor T2 in the N+1th pixel cell 128 is supplied with the negative bias voltage −Vgs and is compensated as mentioned above.

Figure 10:
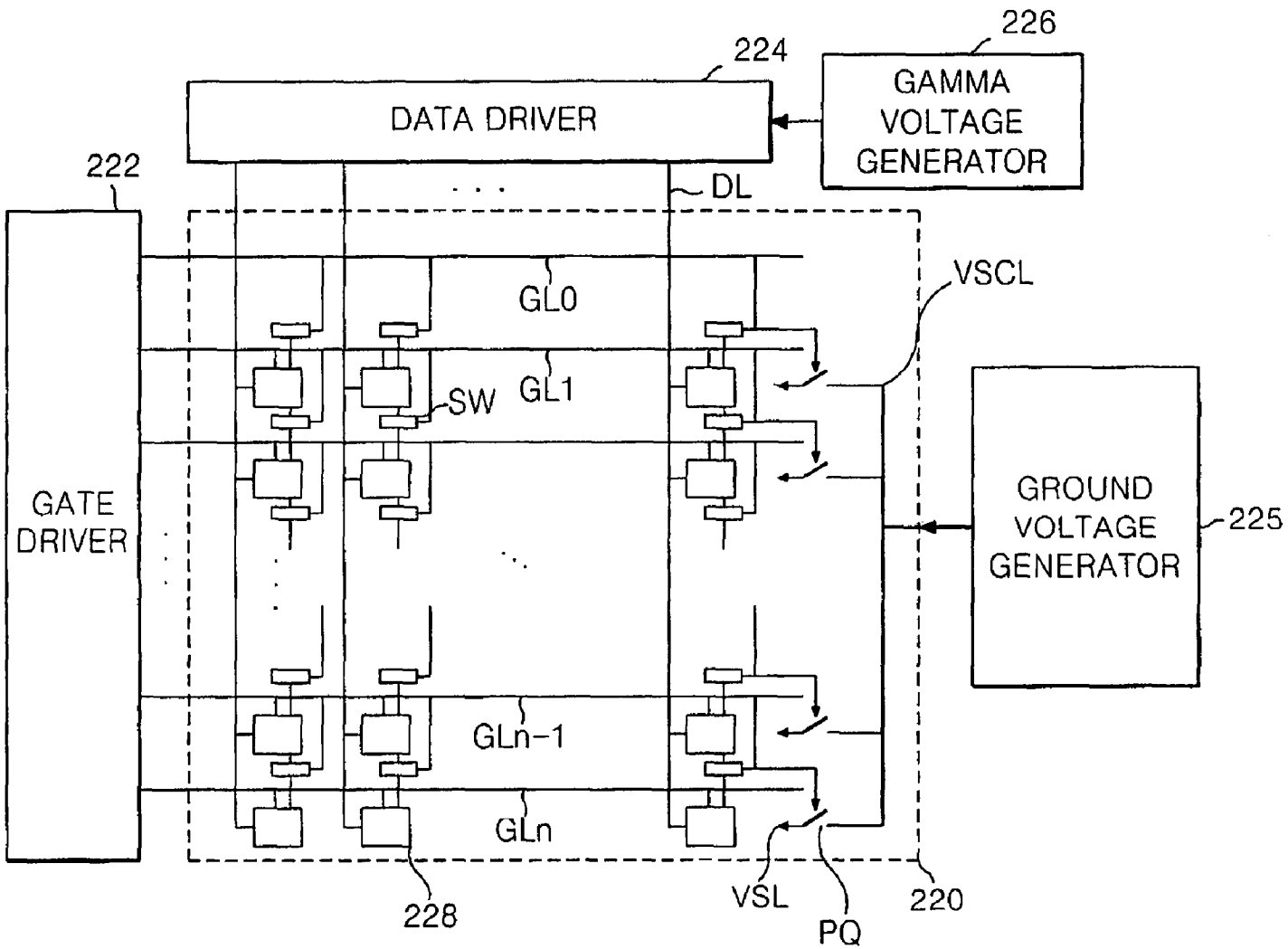
FIG. 10 is a schematic block diagram of an electro-luminescence display according to a second embodiment of the present invention.
Figure 11:
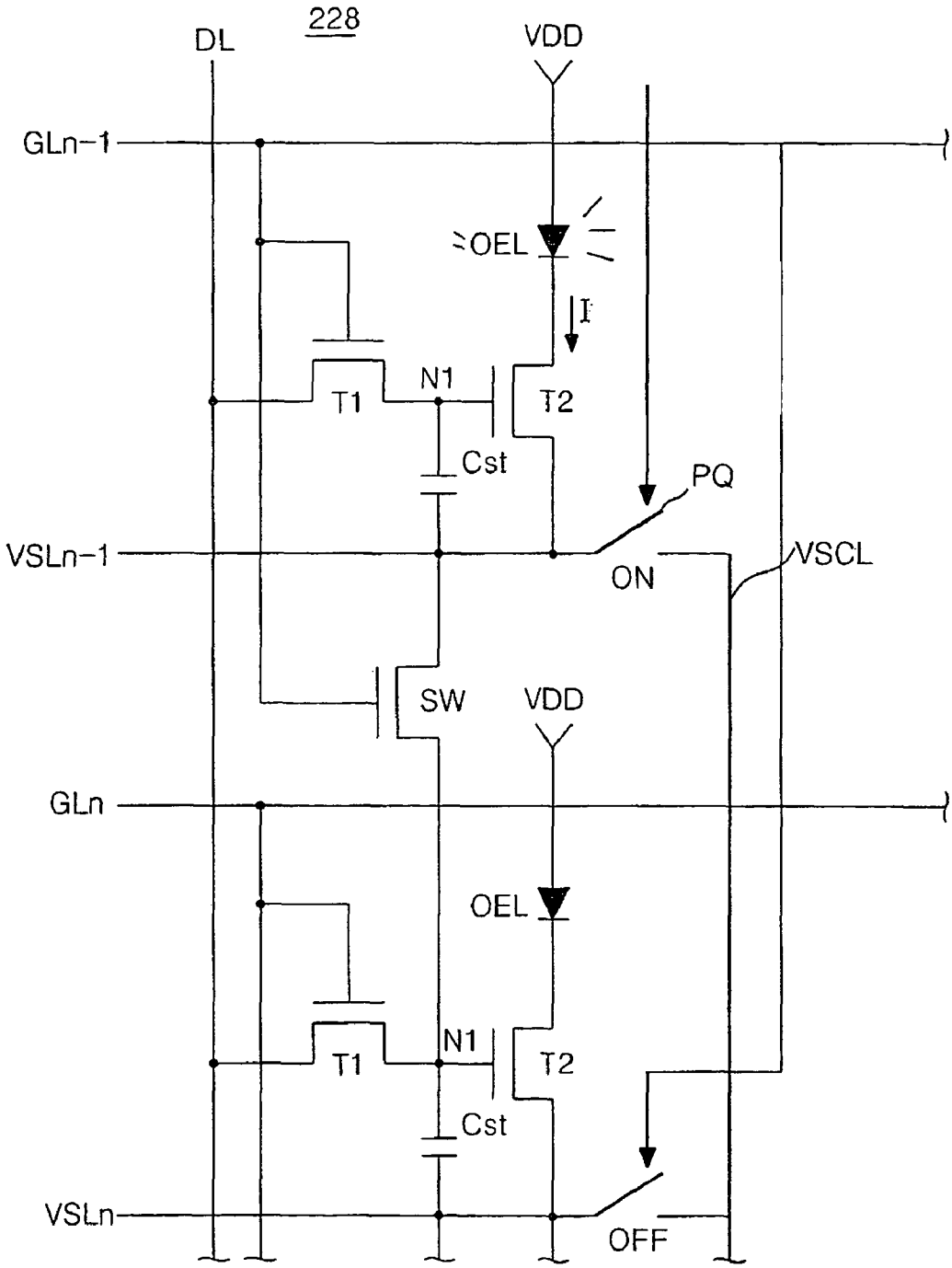
FIG. 11 is a circuit diagram of the pixel shown in FIG. 10.

FIGS. 10 and 11 show an EL display according to a second embodiment of the present invention, which includes a EL panel 220 having a pixel arranged at each crossing between gate lines GL and data lines DL, a gate driver 222 driving the gate lines GL of the EL panel 220, a data driver 224 driving the data lines DL of the EL, a gamma voltage generator 226 supplying a plurality of gamma voltages to the data driver 224, a compensation voltage generator 225 generating a compensation voltage VSS, a plurality of bias switches SW connected between adjacent pixels 228 in a vertical direction to supply the compensation voltage VSS from the compensation voltage supply line VSLn-1 to the adjacent pixels 228 and a plurality of built-in switches PQ connected between the compensation voltage supply line VSL and the compensation voltage generator 225 and cutting-off the compensation voltage VSS supplied to the compensation voltage supply line VSL from the compensation voltage generator 225 depending upon the scan pulse supplied to the gate line GL of previous stage.

In the EL display according to the second embodiment of the present invention, because the operation of the gate driver 222, the data driver 224, the gamma voltage generator 226, the pixels 228 and the bias switches SW is identical to that of the EL display devices according to the first embodiment of the present invention that operation will not be described again here.

The compensation voltage generator 225 generates the compensation voltage VSS and supplies it to the plurality of compensation voltage supply lines VSL through the ground voltage common line VSCL on the EL panel 220.

Each of the built-in switches PQ is turned off by the scan pulse supplied to the gate line GL of previous stage to cut-off the compensation voltage VSS supplied from the ground voltage common line VSCL to the compensation voltage supply line VSL. The built-in switch PQ may be a switching thin film transistor T1 of the pixel 228, a driving thin film transistor T2, a bias switch SW and a P type thin film transistor. In other words, the switching thin film transistor T1, the driving thin film transistor T2 and the bias switch SW may be N type thin film transistors, and the built-in switch PQ may be a P type thin film transistor. The built-in switch is turned off during the period where the scan pulse is supplied from the gate line GL of a previous pixel and is turned on except during this period. Thus, the built-in switch PQ forms the connection of the ground voltage common line VSCL with the source terminal of the driving thin film transistor T2 depending upon the scan pulse from the gate line of previous pixel GL or floats the ground voltage common line VSCL.

The compensation voltage supply line VSL is connected to the source terminal of the driving thin film transistor T2 or is floated depending on the switch position of the built-in switch PQ. In this case, the built-in switch PQ is turned off such that the floating compensation voltage supply line VSL has a voltage, which is lower than the supply voltage VDD supplied from the voltage source VDD, and the floating voltage has a valve between the data voltage VD and the supplying voltage VDD.

If the compensation voltage supply line VSL floats, an inverse bias voltage is supplied to the driving thin film transistor T2 such that a threshold voltage Vth of the driving thin film transistor T2 is compensated.

As described above according to a second embodiment of the present invention, the EL display and the driving method thereof includes displaying an image on the N−1th pixel cell using the scan pulse supplied to a N−1th gate line GLn-1, and at the same time, supplying the negative bias voltage −Vgs to the driving thin film transistor T2 of the Nth pixel 228 using the scan pulse in the N−1th gate line GLn-1, to compensate for the change in the threshold voltage Vth of the driving thin film transistor T2 driving the Nth pixel. The N−1th pixel is connected to the gate line GLn-1 and the Nth pixel is connected to the gate line GLn.

The scan pulse is supplied to the gate line GLn-1 of the N−1th pixel such that the switching thin film transistor T1 of the N−1th pixel and the bias switch SW are turned on. At this time, the built-in switch PQ connected to the N−1th gate line GLn-1 maintains the on state by the scan pulse supplied to the gate line GLn-1 and the built-in switch PQ connected the Nth compensation voltage supply line VSLn is turned off by the scan pulse supplied to the gate line GLn-1.

In this case, the switching thin film transistor T1 of the N−1th pixel is turned on such that the data signal VD supplied to the data line DL is supplied to the first node N1 via the switching thin film transistor T1 of the N−1th pixel. The data signal VD supplied to the first node N1 is charged onto the storage capacitor Cst and applied to the gate terminal of the driving thin film transistor T2 of the N−1th pixel. Accordingly, the driving thin film transistor T2 of the N−1th pixel controls a current I flowing from the voltage source VDD to the compensation voltage supply line VSLn-1 through EL cell OEL in response to the data signal applied to the gate terminal to control the amount of light emitted from the EL cell OEL.

At the same time, the bias switch SW is turned on by the scan pulse supplied to the gate line GLn-1 such that the compensation voltage VSS supplied the ground supply line VSLn-1 is supplied to the first node N1 of the Nth pixel cell through the bias switch SW. At this time, the compensation voltage supply line VSLn floats because the built-in switch PQ is turned off by the scan pulse supplied to gate line GLn-1. The compensation voltage VSS is supplied to the gate terminal of the driving thin film transistor T2 in the Nth pixel and the source terminal floats. Thus, when the scan pulse is supplied to the gate line GLn-1, the negative bias voltage −Vgs is supplied to the driving thin film transistor T2 of the Nth pixel. Consequently, the threshold voltage Vth of the driving thin film transistor T2 in the Nth pixel 228 is compensated for by the negative bias −Vgs.

On the other hand, the scan pulse supplied to the gate line GLn-1 is turned off and the scan pulse is supplied to the gate line GLn. Therefore, even though the switching thin film transistor T1 of the N−1th pixel is turned off, the driving thin film transistor T2 of the N−1th pixel maintains an on state because of the charge on the storage capacitor Cst corresponding to the data signal VD to control the current I flowing from the voltage source VDD through the EL cell OEL until a data signal for the next frame is supplied. At the same time, the driving thin film transistor T2 of the Nth pixel is turned on by the scan pulse supplied to the gate line GLn to control the current I supplied to the Nth pixel. The threshold voltage Vth of the driving thin film transistor T2 in the N+1th pixel is supplied with the negative bias voltage −Vgs and is compensated as described above.

As set forth above, the EL display according to the second embodiment of the present invention forms each of built-in switches of N type devices and inverts the scan pulse from the gate line GLn-1 of the previous pixel to act as a supplying inverter, in order to control the built-in switch PQ as described above.

Figure 12:
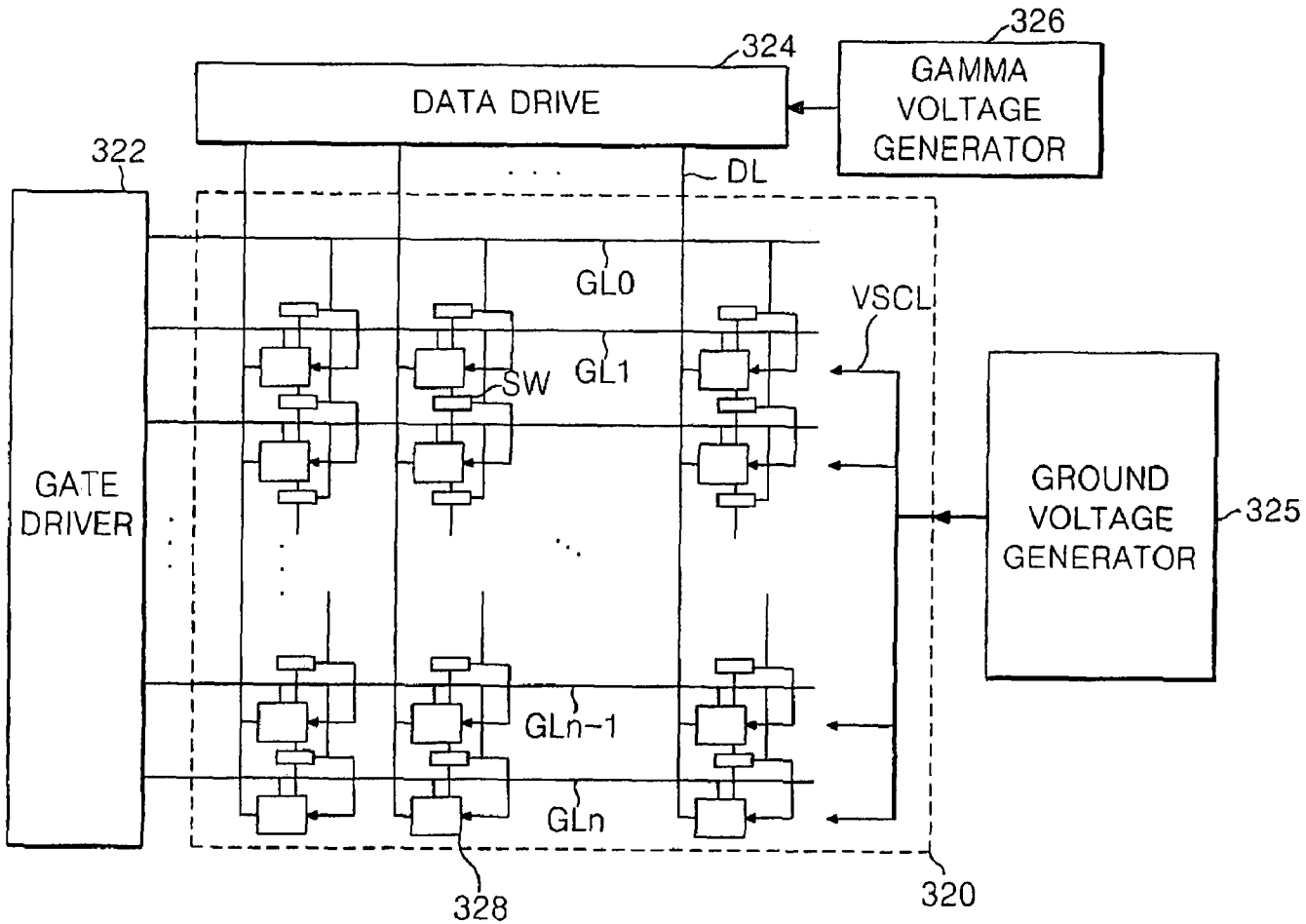
FIG. 12 is a schematic block diagram of an electro-luminescence display according to a third embodiment of the present invention.
Figure 13:
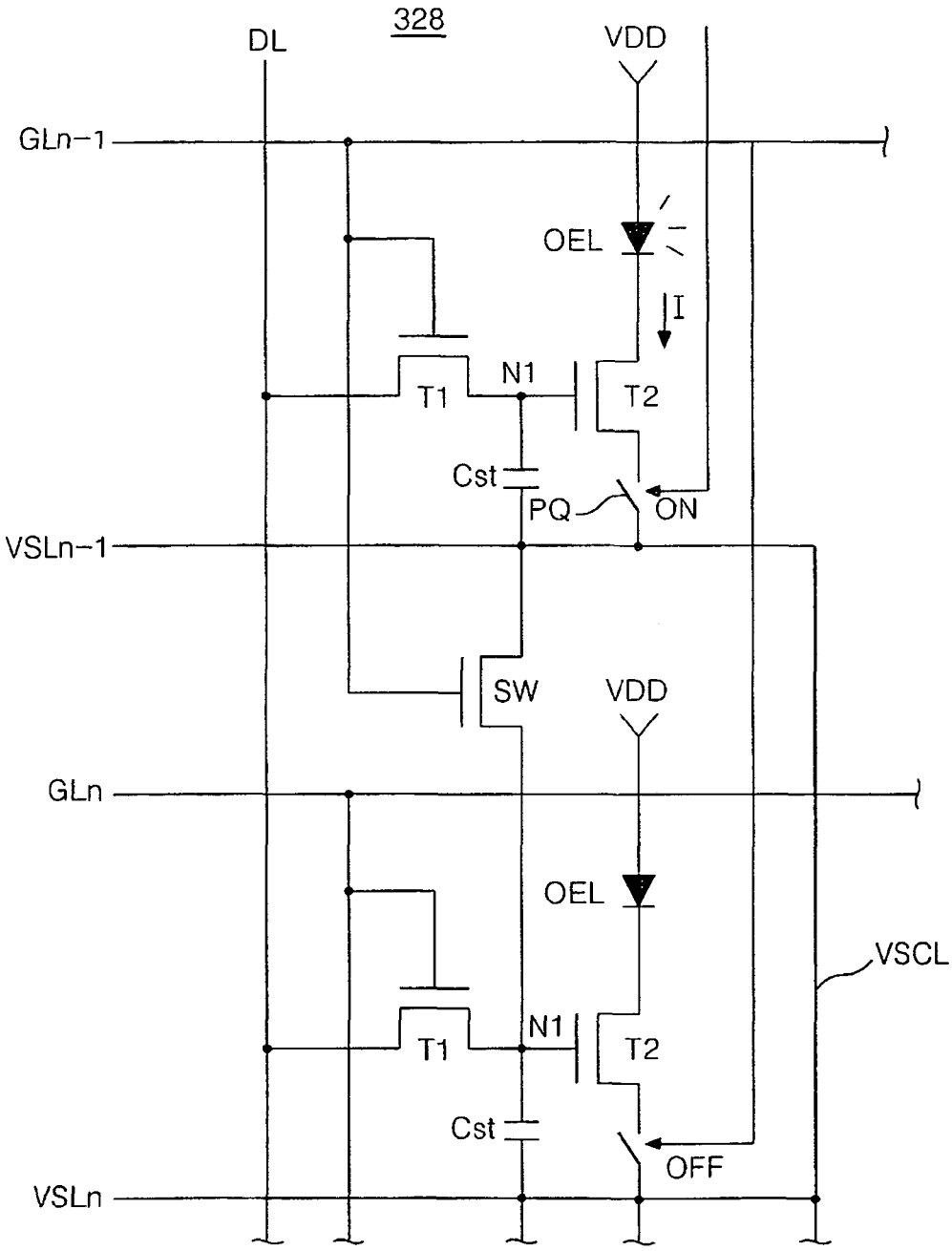
FIG. 13 is a circuit diagram of the pixel shown in FIG. 12.

With reference to FIGS. 12 and 13 show an EL display according to a third embodiment of the present invention, which includes a EL panel 320 having a pixel arranged at each crossing between gate lines GL and data lines DL, a gate driver 322 driving the gate lines GL of the EL panel 320, a data driver 324 driving the data lines DL of the EL panel 320, a gamma voltage generator 326 supplying a plurality of gamma voltages to the data driver 324, a compensation voltage generator 325 generating a compensation voltage VSS, a plurality of bias switches SW connected between adjacent pixels 328 in a vertical direction to supply the compensation voltage VSS from the compensation voltage supply line VSLn-1 to the adjacent pixels 328 and a plurality of built-in switches PQ connected between the compensation voltage supply line VSL and the pixel 328 depending upon the scan pulse supplied to the gate lines GL of previous stage.

In the EL display according to the third embodiment of the present invention, because the operation of the gate driver 322, the data driver 324, the gamma voltage generator 326, the pixels 328 and the bias switches SW is identical to that of the EL display devices according to the first embodiment of the present invention that operation will not be described again here.

The compensation voltage generator 325 generates the compensation voltage VSS and supplies it to a plurality of compensation voltage supply lines VSL through the ground voltage common lines VSCL on the EL panel 320.

Each of the built-in switches PQ is turned off and connected between a source terminal of the driving thin film transistor T2 in the pixels 328 and a ground voltage common line VSCL. The built-in switch PQ cuts off the connection between the source terminal of the driving thin film transistor T2 and the ground voltage common line VSCL by the scan pulse supplied to the gate line GL of previous stage. The built-in switch PQ may be a switching thin film transistor T1 of the pixel 328, a driving thin film transistor T2, a bias switches SW and a P type thin film transistor. In other words, the switch thin film transistors T1, the driving thin film transistor T2 and the biases switch SW may be N type thin film transistors, and the built-in switch PQ may be a P type thin film transistor. The built-in switch is turned off during the period where the scan pulse is supplied from the gate line GL of previous pixel and is turned on except during this period. Thus, the built-in switch PQ connects the ground voltage common line VSCL depending upon the scan pulse from the gate line GL of previous pixel to the source terminal of the driving thin film transistor T2.

Each of the compensation voltage supply lines VSL is sequentially connected to the source terminal of the driving thin film transistor T2 by the switching operation of each of the built-in switches PQ.

When the built-in switch PQ is turned off, the source terminal of the driving thin film transistor T2 floats. Accordingly, the source of the driving thin film transistor T2 has a voltage, which is lower than the supply voltage VDD supplied from the voltage source VDD, and the float voltage has a value between the data voltage VD and the supplying voltage VDD.

If the source of the driving thin film transistor T2 is floats, an inverse bias voltage is supplied to the driving thin film transistor T2 such that the threshold voltage Vth of the driving thin film transistor T2 is compensated.

As described above according to the third embodiment of the present invention, the EL display and driving method thereof include displaying an image on the N−1th pixel using the scan pulse supplied to a gate line GLn-1, and at the same time, supplying the negative bias voltage −Vgs to the driving thin film transistor T2 of the Nth pixel 328 using the scan pulse supplied in the gate line GLn-1, to compensate for the change in the threshold voltage Vth of the driving thin film transistor T2 driving the Nth pixel. The Nth pixel is connected to the gate line GLn-1 and the Nth pixel 328 is connected to the gate line GLn.

The scan pulse is supplied to the gate line GLn-1 of the N−1th pixel such that the switching thin film transistor T1 of the N−1th pixel 328 and the bias switch are turned on. At this time, the built-in switch PQ connected to the compensation voltage supply line VSLn-1 maintains an on state by the scan pulse supplied to the gate line GLn-1 and the built-in switch PQ connected to the compensation voltage supply line VSLn is turned off by the scan pulse supplied to the gate line GLn-1.

In this case, the switching thin film transistor T1 of the N−1th pixel is turned on such that the data signal VD supplied to the data line DL is supplied to the first node N1 via the switching thin film transistor T1 of the N−1th pixel. The data signal VD supplied on the first node N1 is charged onto the storage capacitor Cst and applied to the gate terminal of the driving thin film transistor T2 in the N−1th pixel. Accordingly, the driving thin film transistor T2 of the N−1th pixel controls the current I flowing from the voltage source VDD to the compensation voltage supply line VSLn-1 via EL cell OEL in response to the data signal applied to the gate terminal to control amount of light emitted from the EL cell OEL.

At the same time, the bias switch SW is turned on by the scan pulse supplied to the gate line GLn-1 such that the compensation voltage VSS supplied to the ground supply line VSLn-1 is supplied to the first node N1 of the Nth pixel through the bias switch SW. At this time, the source terminal of the driving thin film transistor T2 in the Nth pixel 328 floats because the built-in switch PQ is turned off by the scan pulse supplied to the gate line GLn-1. The compensation voltage VSS is supplied to the gate terminal of the driving thin film transistor T2 in the Nth pixel and a floating voltage is supplied to the source terminal. Thus, when the scan pulse is supplied to the gate line GLn-1, the negative bias voltage −Vgs is supplied to the driving thin film transistor T2 of the Nth pixel. As a result, the threshold voltage Vth of the driving thin film transistor T2 in the Nth pixel is compensated for by the negative bias −Vgs.

On the other hand, the scan pulse supplied to the gate line GLn-1 is turned off and the scan pulse is supplied to the gate line GLn. Therefore, even though the switching thin film transistor T1 of the N−1th pixel is turned off, the driving thin film transistor T2 of the N−1th pixel maintains on state because of corresponding to the data signal VD charged onto the storage capacitor Cst to control the current I flowing from the voltage source VDD through the EL cell OEL until a data signal for the next frame is supplied. At the same time, the driving thin film transistor T2 of the Nth pixel is turned on by the scan pulse supplied to the gate line GLn to control the current I supplied to the Nth pixel. The threshold of the driving thin film transistor T2 in the N+1th pixel is supplied with the negative bias voltage −Vgs and is compensated as described above.

As set forth above, the EL display according to the third embodiment of the present invention forms the built-in switches PQ of N type devices and inverts the scan pulse from the gate line GLn-1 of the previous pixel to act as a supplying inverter, in order to control the built-in switch PQ.

As mentioned above, the electro-luminescence display and driving method thereof according to the embodiments of the present invention includes the bias switch connected between the N−1 the pixels and the Nth pixels. The present invention supplies the inverse bias voltage to the driving thin film transistor driving the Nth pixel using the scan pulse supplied to the gate line of previous pixel and compensates the threshold voltage. Thus, the present invention is able to compensate for the deterioration of the driving thin film transistor in order to improve the quality of the displayed image. Furthermore, the present invention compensates the threshold voltage of the driving thin film transistor to prevent the brightness from decreasing to prevent the deterioration of picture quality by an residual image.

It will be apparent to those skilled in the art that various modifications and variation can be made in the present invention without departing from the spirit or scope of the invention. Thus, it is intended that the present invention cover the modification and variations of this invention provided they come within the scope of the appended claims and their equivalents.

What is claimed is:

1. An electro-luminescence display, comprising:

a plurality of drive voltage supply lines;

a plurality of compensation voltage supply lines;

EL cells at each crossing of a plurality of data lines and a plurality of gate lines in a matrix, wherein the EL cells emit light in response to currents applied from the drive voltage supply lines;

driving thin film transistors (TFTs) connected between the EL cells and compensation voltage supply lines that control the current applied to the EL cells; and a bias switch, connected between a N−1th compensation voltage supply line of the plurality of compensation voltage supply lines and a control terminal of a Nth driving TFT connected to a Nth compensation voltage supply line of the plurality of compensation voltage supply lines to apply a negative bias voltage to the Nth driving TFT connected to the Nth compensation voltage supply line, thereby compensating for a change of threshold voltage of the Nth driving TFT when a scan pulse is supplied to a N−1th gate line of the plurality of gate lines, wherein the bias switch is controlled by the scan pulse supplied to the N−1th gate line, and wherein the bias switch includes:

a control terminal connected to the N−1th gate line;

a first input terminal connected to the N−1th compensation voltage supply line; and a second input terminal connected to the control terminal of the Nth driving TFT that is connected to the Nth compensation voltage supply line.

2. The EL display of claim 1, further comprising:

a switching thin film transistor, connected to the gate line, the data line and the control terminal of the driving TFT; and a storage capacitor connected between the compensation voltage supply line and the control terminal of the driving TFT.

3. The EL display of claim 2, further comprising:

a compensation voltage generator that generates a compensation voltage with a high state; and a shift register that sequentially shifts the compensation voltage with a high state to supply the compensation voltage to the plurality of compensation voltage supply lines.

4. The EL display of claim 3, wherein when the scan pulse is supplied to the N−1th gate line, the compensation voltage with a high state from the shift register is supplied to the Nth compensation voltage supply line and the compensation voltage with a low state from the shift register is supplied to the N−1th compensation voltage supply line.

5. The EL display of claim 4, wherein when the scan pulse is supplied to the N−1th gate line, the control terminal of the driving TFT is supplied with data via the switching TFT and the second input terminal is supplied with a compensation voltage with a low state from the N−1th compensation voltage supply line.

6. The EL display of claim 4, wherein when the scan pulse is supplied to the N−1th gate line, the bias switch supplies a compensation voltage with low state from the N−1th compensation voltage supply line to the control terminal of the driving TFT connected to the Nth compensation voltage supply line and a compensation voltage of high state is supplied from the Nth compensation voltage supply line to the second input terminal of the driving TFT.

* * * * *